US005906447A

United States Patent [19]

Horikoshi

[11] Patent Number: 5,906,447

[45] Date of Patent: May 25, 1999

[54] WRITING UTENSIL

[75] Inventor: Kenichi Horikoshi, Tokyo, Japan

[73] Assignee: Zebra Co., Ltd., Tokyo, Japan

[21] Appl. No.: 08/981,013

[22] PCT Filed: May 23, 1996

[86] PCT No.: PCT/JP96/01360

§ 371 Date: Dec. 24, 1997

§ 102(e) Date: Dec. 24, 1997

[87] PCT Pub. No.: WO97/44200

PCT Pub. Date: Nov. 27, 1997

[51] Int. Cl.[6] ..... B43K 7/10

[52] U.S. Cl. ..... 401/214; 401/4

[58] Field of Search ..... 401/214, 4

[56] References Cited

U.S. PATENT DOCUMENTS 4,281,779 8/1981 Shepard ..... 401/214 X

FOREIGN PATENT DOCUMENTS 5-51480 7/1993 Japan .
5-58362 8/1993 Japan .
5-76568 10/1993 Japan .
5-76569 10/1993 Japan .
6-7984 2/1994 Japan .
6-7985 2/1994 Japan .
8-52984 2/1996 Japan .

*Primary Examiner*—Steven A. Bratlie
*Attorney, Agent, or Firm*—Greenblum & Bernstein P.L.C.

[57] ABSTRACT

An applicator for the correction of clerical errors or a writing tool such as a ball-point pen or the like is disclosed wherein a tip containing a rotary element, the rotary element being biased into contact with an inward front-end edge of the tip by a coil spring, is connected through a ferrule holder to an ink tank containing a solid-liquid separable ink. The ink is discharged and transferred onto a writing paper by moving the rotary element inwardly from the front-end of the tip against the bias of the coil spring. A support piece is disposed within the ferrule holder, the support piece being an integrally molded piece including a cylindrical portion disposed within the ferrule holder in close contact with the inner surface of the ferrule holder, a plurality of support arms inclined in a generally conical shape gradually from a front-end opening edge of the cylindrical portion toward the front, and a spring bearing portion supported contiguously to the front ends of the support arms and concentrically toward the front. When the writing tool is left standing with its pen point facing up, the solid-liquid separable ink staying in both tip and ferrule holder returns quickly to the ink tank through large, open ink flow ports at an opening area at least from the rear end of the spring bearing portion to the front-end opening edge of the cylindrical portion in the space between adjacent support arms of the support piece.

4 Claims, 4 Drawing Sheets

WRITING UTENSIL

BACKGROUND OF THE INVENTION

1. Field of the Invention

The present invention relates to a writing tool and more particularly to an applicator for the correction of clerical errors or to a writing tool such as a ball-point pen wherein a tip containing a rotary element, the rotary element being biased forward into contact with an inward front-end edge of the tip by means of a coil spring, is connected with an ink tank through a ferrule holder. The ink tank containing a solid-liquid separable ink and an agitation member, and when the applicator or the writing tool is to be used, the rotary element retracts from the inward front-end against the coil spring, allowing the ink to be discharged and transferred onto a writing paper.

2. Description of Background Information

According to a conventional writing tool of this type, as shown in FIGS. 8A and 8B, a tip 21 containing a rotary element 22 inside its front end, the rotary element 22 being biased forward into contact with an inward front-end edge 21-1 of the tip by means of a coiled spring 20, is connected with the front end of an ink tank 24 through a ferrule holder 23. The rotary element 22 retracts away from the inward front-end edge 21-1 of the tip 21 against the coiled spring 20, whereby a solid-liquid separable ink 25 which has been fed from the ink tank 24 into the tip 21 through the ferrule holder 23 is discharged and transferred onto a writing paper or the like through a front-end opening of the tip formed by the retreat of the rotary element (this construction is known, for example, in Japanese Utility Model Laid-Open Nos. HEI 5-51480, 5-58362, 5-76568, 6-7984 and 6-7985).

The solid-liquid separable ink has the property that when left standing for a long time, the solid component of the ink is precipitated and agglomerated to form a cake. Therefore, when the writing tool is to be left standing for a long time after use, it is necessary that the ink residue in both ferrule holder and tip should return quickly into the ink tank. Otherwise, the solid component of the ink would begin to precipitate, with agglomeration of the precipitated solid component and formation of a cake. This may result in that the motion of the coiled spring and that of the rotary element are prevented completely by the cake. In other words, the opening/closing function of a valve mechanism constituted by both the inward front-end edge of the tip and the rotary element is lost completely by the cake, with the result that the writing tool eventually becomes unemployable and is compelled to be discarded.

In the above conventional writing tool, however, the sectional area of the ink flow path from the ferrule holder 23 to the tip 21 is narrow and the ink 25 resists flow, so even if the writing tool after use is left standing with its pen point facing up, the ink 25 remaining in both tip 21 and ferrule holder 23 is unable to return completely into the ink tank 24. Consequently, with the lapse of time, the ink 25 separates into solids and liquid and the solid component begins to precipitate, with agglomeration and formation of a cake within the tip 21 and the ferrule holder 23. Thus, in the conventional writing tool containing a solid-liquid separable ink in the ink tank, the cake formed by such precipitation and agglomeration of the solid component of the ink frequently gives rise to problems, and a remedial measure has been desired.

Accordingly, it is an object of the present invention to provide a writing tool wherein the residue of ink in both the tip and ferrule holder returns quickly into an ink tank by turning the pen point upward after use. It is another object of the present invention to provide a writing tool wherein a coiled spring for biasing a rotary element forward can be mounted easily so as to exert a constant biasing force continually on the rotary element.

SUMMARY OF THE INVENTION

According to the present invention, in a writing tool wherein a tip containing a rotary element, the rotary element is biased forward into contact with an inward front-end edge of the tip by means of a coiled spring, and is connected through a ferrule holder with an ink tank containing a solid-liquid separable ink and also containing an agitation member. A support piece holding the coiled spring and having an ink flow port which provides communication between the ink tank and the ferrule holder is disposed in the interior of the ferrule holder. The support piece is formed by integrally molded components which include a cylindrical portion having front and rear openings and disposed within the ferrule holder in close contact with the inner surface of the same holder. A plurality of support arms incline gradually forward in a generally conical shape from the front-end opening edge of the cylindrical portion, and a cylindrical spring bearing portion is contiguous with the front end of the support arms and supported concentrically in the forward direction. The rear end of a coil spring is inserted and held in the spring bearing portion so as to be coaxial and resilient toward the rotary element. The ink in the ink tank is supplied into the ferrule holder from ink flow ports, and the ink flow ports each have an opening at least from the rear end of the spring bearing portion up to the front-end opening edge of the cylindrical portion between adjacent support arms.

According to this construction, when the pen point is turned up after use of the writing tool, the residue of ink in both the tip and ferrule holder is returned quickly to the ink tank through the ink flow ports of the support piece. The ink flow ports each include a large opening area from the rear end of the spring bearing portion up to the front-end opening edge of the cylindrical portion between adjacent support arms which connect the cylindrical portion and the spring bearing portion with each other. Furthermore, the coil spring can be inserted into the support piece to face the rotary element present inside the front end of the tip while it is held by the spring bearing portion of the support piece and while it is centered with respect to the axis of the tip. Thus, the coil spring mounting operation is easy.

Moreover, according to the present invention, inwardly projecting protrusions are formed on the inner surface of the support piece portion where by the cylindrical portion and the support arms are contiguous to each other in such a manner that the inside diameter of a circle connecting the projecting inner surfaces of the protrusions has a size smaller than the outside diameter, or spherical diameter, of the agitation member. Thus, the projecting end faces of the protrusions on the rear-end opening side of the cylindrical portion are positioned in a plane in the circumferential direction. Consequently, there is attained a sufficient strength of the connection between each support arm and the cylindrical portion. Moreover, when the agitation member, which is contained in the ink tank together with ink, moves to the pen point side by its own weight, it is received by the projecting end faces of the protrusions which are positioned in a plane in the circumferential direction.

Further, according to the present invention, a retaining flange projecting outward in the shape of a ring is formed at the rear-end opening edge of the cylindrical portion of the support piece. The inner surface of the connection port of the ferrule holder with the ink tank is formed with a restricting stepped portion for abutment therewith by the aforesaid retaining flange at the time of insertion of the support piece into the ferrule holder to limit the insertion of the support piece into the ferrule holder.

According to this construction, if the support piece is inserted into the ferrule holder from the connection port of the holder with the ink tank after allowing the coil spring to be held by the spring bearing portion, the retaining flange of the cylindrical portion comes into abutment with the restricting stepped portion of the ferrule holder, thereby limiting the amount of the support piece inserted into the ferrule holder. In other words, the coil spring can be kept in abutment always at a constant biasing force with the rotary element located within the front end of the tip.

According to the present invention, the rear end of the coil spring is inserted and held in the spring bearing portion of the support piece by press-fitting or by threading, whereby the coil spring can be held firmly in the spring bearing portion of the support piece.

DETAILED DESCRIPTION OF THE PREFERRED EMBODIMENTS

The present invention will be described below in more detail with reference to the accompanying drawings.

Figure 1A:
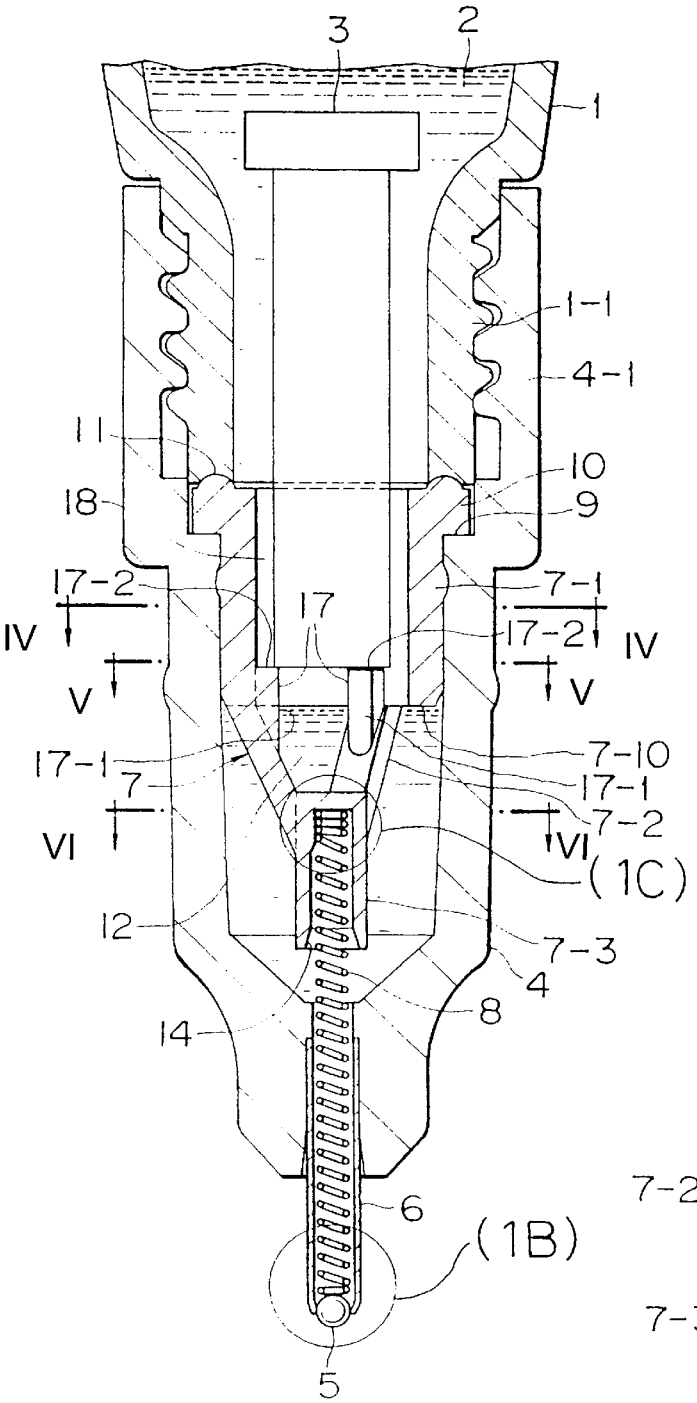
FIG. 1A is a longitudinal sectional view of a writing tool according to an embodiment of the present invention.
Figure 1B:
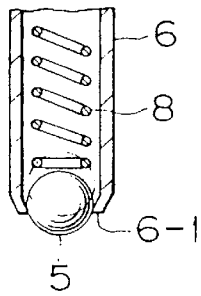
FIG. 1B is an enlarged view of the portion IB in FIG. 1A.

FIG. 1A shows a writing tool according to an embodiment of the present invention. In the same figure, an ink tank 1 is an integrally molded tank of a pen type or a bottle type, which is formed of a synthetic resin material or the like. The ink tank 1 contains a solid-liquid separable ink 2 and a rod-like agitation member 3. When the ink tank 1 is shaken up and down or right and left, the solid-liquid separable ink 2 is agitated by the agitation member 3. A ferrule holder 4 is connected to a front-end port 1-1 of the ink tank 1 in a sealed state to prevent leakage of the ink 2, and to the front end of the ferrule holder 4 is connected a tip 6 which holds a rotary element 5 in the interior of its front end. The rotary element 5 is biased forward into contact with an inward front-end edge 6-1 of the tip 6 by means of a coil spring 8, the coil spring 8 being held by a spring bearing portion 7-3, to be described later, of a support piece 7 and extending from the holder 4 into the tip 6 and set therein, the support piece 7 being fitted in the holder 4. The front-end opening of the tip 6 is closed by virtue of the coil spring 8 (the state indicated with solid line in FIG. 1B). When the writing tool is to be used, the rotary element 5 is brought into contact with the surface of a writing paper, allowing the rotary element 5 to be retracted inward of the tip 6 and away from the inward front-end edge 6-1 against the biasing force of the coil spring 8, to open the front-end opening of the tip 6, whereby the ink 2 is discharged and transferred onto the writing paper surface (the state indicated with dash-double dot line in FIG. 1B).

The ferrule holder 4, like the ink tank 1, is an integrally molded holder formed of a synthetic resin or the like and is formed in the shape of a stepped cylinder and with a generally tapered shape with the front end constricted. The tip 6 is connected to the front end of the ferrule holder 4 by press-fitting or any other suitable means. A connection port 4-1 at the rear end thereof is formed with integrally molded threads which are threadedly connected to the front-end port 1-1 of the ink tank 1. At an open base end of the connection port 4-1 is formed a restricting stepped portion 9 to restrict the depth of insertion of the support piece 7 into the ferrule holder 4. When the support piece 7 is inserted into the holder 4, a retaining flange 10 which will be described later comes into abutment with the restricting stepped portion 9.

The tip 6 is a pipe of a small diameter formed by using a metallic material or the like. The front-end opening of the tip 6 is bent inwardly to form the inward front-end 6-1, and the roary element 5, which is also formed of a metallic material or the like, is brought into contact with the front-end edge 6-1 by the coil spring 8 to close the front-end opening of the tip. Thus, in order to prevent unnecessary discharge of the ink 2, the tip 6 is equipped at the front end thereof with a valve mechanism including the inward front-end 6-1 and the rotary element 5.

The support piece 7, which is an integrally molded piece obtained by using a synthetic material or the like, includes a cylindrical portion 7-1 fitted in the ferrule holder 4 in close contact with the inner surface of the ferrule and being open in the front and rear ends thereof. A plurality of support arms 7-2 gradually inclined from a front-end opening edge 7-10 of the cylindrical portion 7-1 toward the front in a generally conical shape, and a cylindrical spring bearing portion 7-3 is contiguous to the front ends of the support arms 7-2 and supported concentrically toward the front. With the coil spring 8 press-fitted or threaded into the spring bearing portion 7-3, the cylindrical portion 7-1 is press-fitted into the ferrule holder 4, whereby the coil spring 8 is loosely fitted in the tip 6 in a concentrically positioned state with respect to the axis of the tip and supports the rotary element 5 resiliently toward the inward front-end edge 6-1 of the tip.

The cylindrical portion 7-1 has a cylindrical shape with a suitable length and has an outside diameter about the same as the inside diameter of the ferrule holder 4 and further has an inside diameter a size larger than the outside diameter of the rod-like agitation member 3. At the rear-end opening edge of the cylindrical portion 7-1 is formed a retaining flange 10 projecting outward in the form of a ring for abutment and engagement therewith of the restricting stepped portion 9 of the ferrule holder 4. When the support piece 7 is inserted into the ferrule holder 4, the retaining flange 10 limits the depth of insertion of the support piece 7 into the holder 4 so as to prevent the support piece from being inserted to a greater extent than necessary. Thus, the support piece 7 can always be mounted in a given position of insertion relative to the ferrule holder 4.

The end face of the cylindrical portion 7-1 having the retaining flange 10 is provided throughout the whole circumference thereof with a seal portion 11 which bites into the end face of the front-end port 1-1 of the ink tank 1 to prevent leakage of the ink from the connection of the ink tank 1 and the ferrule holder 4.

The support arms 7-2 extend from the front-end opening edge 7-10 of the cylindrical portion 7-1 in a gradually inclined state and have a rectangular shape in section corresponding to the wall thickness of the cylindrical portion 7-1, at several circumferential positions, three positions spaced at equal intervals in the circumferential direction in the drawings, so as to be in a generally conical shape toward the front. The thus-extending front ends of the support arms 7-2 support the outer peripheral surface of the rear end of the spring bearing portion 7-3 in an integral and contiguous manner, thereby forming ink flow ports 12 between the rear end of the spring bearing portion 7-3 and the front-end opening edge 7-10 of the cylindrical portion 7-1, the ink flow ports 12 providing communication between the ink tank 1 and the ferrule holder 4.

The ink flow ports 12 each form a large open area from the rear end of the spring bearing portion 7-3 to the front-end opening edge 7-10 of the cylindrical portion 7-1 in the space between adjacent ones of the three support arms 7-2 which connect the front-end opening edge 7-10 of the cylindrical portion 7-1 integrally with the rear end of the spring bearing portion 7-3 at equal intervals in the circumferential direction. Therefore, when the writing tool after use is left standing with its pen point or the tip 6 facing up, the ink 2 present in both tip 6 and ferrule holder 4 returns quickly into the ink tank 1 through the ink flow ports 12 without staying in the interiors of the tip and holder.

The spring bearing portion 7-3 functions to hold the rear end of the coil spring 8 in an inserted state, and it is formed so as to have an inside diameter which is almost equal to or a size larger than the spiral outside diameter of the coil spring 8. The spring bearing portion 7-3 is formed in the shape of a bottomed cylinder having a depth which permits the rear end side of the coil spring 8 to be inserted in a suitable range of length. The spring bearing portion 7-3 is supported in an integral and contiguous manner by end portions of the support arms 7-2 extending in a gradually inclined state from the front-end opening edge 7-10 of the cylindrical portion 7-1 toward the outer peripheral surface of the closed rear end side of the spring bearing portion. In this way the spring bearing portion 7-3 is connected to the front of the cylindrical portion 7-1 concentrically at an appropriate spacing from the cylindrical portion.

Figure 1C:
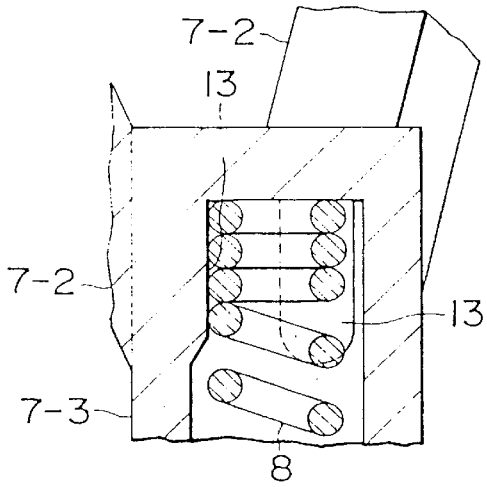
FIG. 1C in an enlarged view of the portion IC in FIG. 1A.
Figure 6:
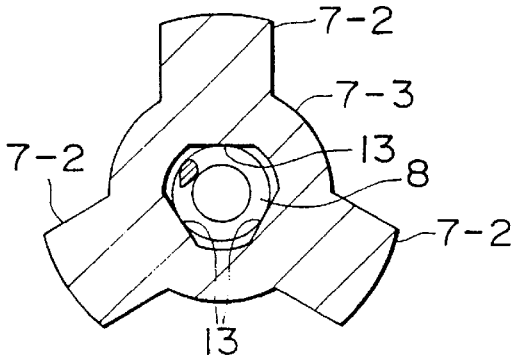
FIG. 6 is an enlarged cross sectional view taken on line VI—VI in FIG. 1A, with a ferrule holder omitted.
Figure 7:
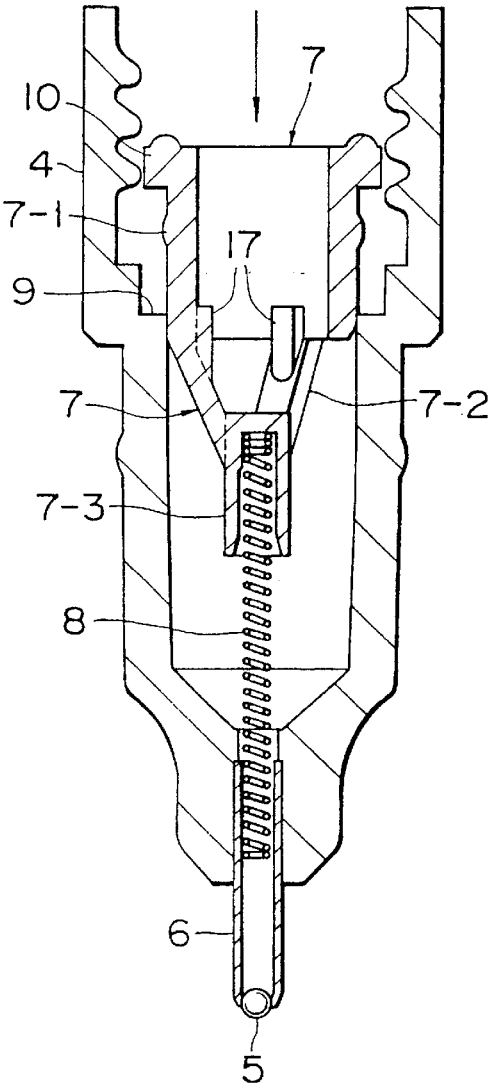
FIG. 7 is a longitudinal sectional view showing in what state the support piece with a coiled spring held therein is inserted into the ferrule holder.
Figure 8A:
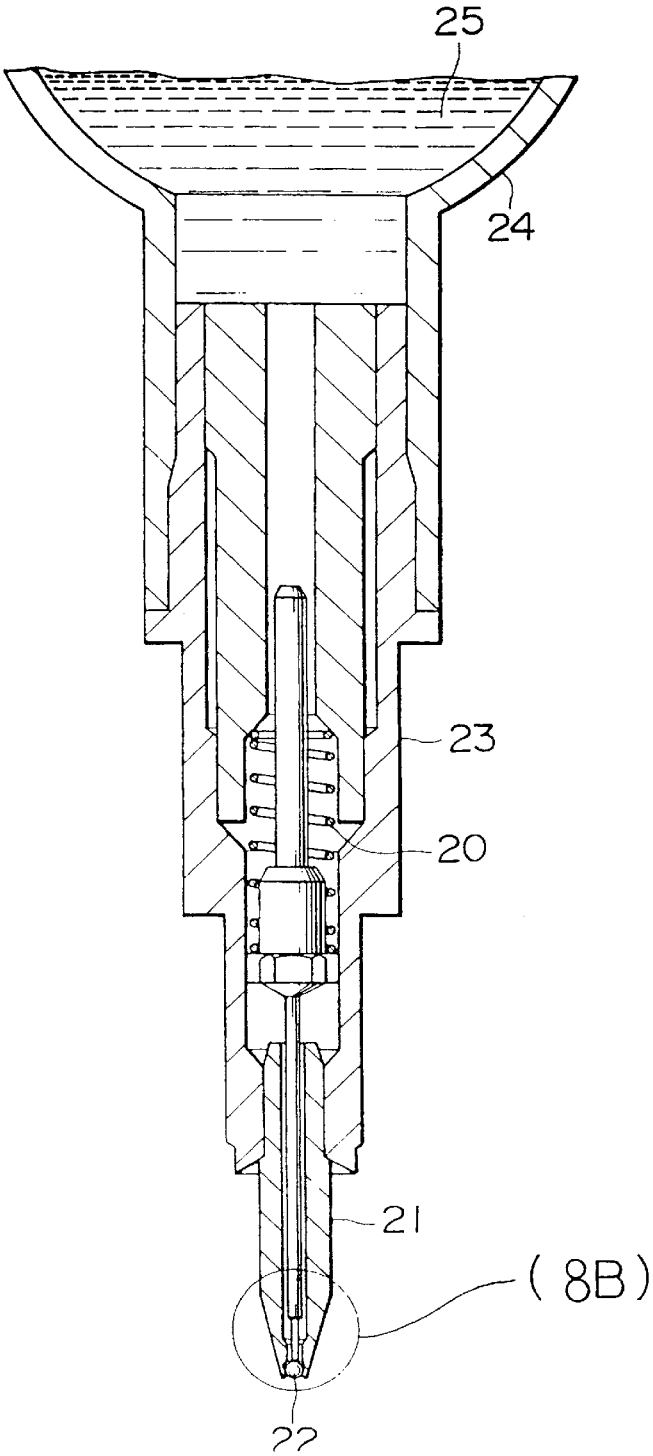
(PRIOR ART) FIG. 8A
FIG. 8A is a longitudinal sectional view showing a conventional example.
Figure 8B:
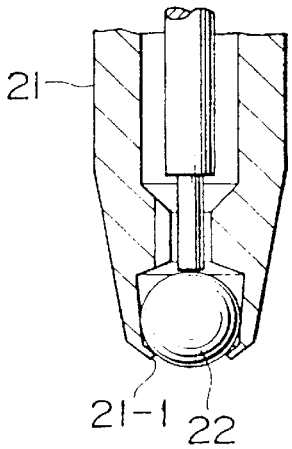
(PRIOR ART) FIG. 8B
FIG. 8B is an enlarged view of the portion 8B in FIG. 8A.

On the inner surface of the internal bottom side of the spring bearing portion 7-3 are formed press-fit portions 13 circumferentially in several positions in an inwardly projecting fashion at a diameter equal to or smaller than the spiral outside diameter of the coil spring 8 (see FIGS. 1C and 6) so that the rear end portion of the coil spring (two or three spirals at the rear end) can be press-fitted and held therein. That is, on the rear end of the coiled spring 8, the portion other than the rear end portion which is press-fitted and held in the press-fit portions 13 of the spring bearing portion 7-3 is loosely inserted into the spring bearing portion 7-3 so that it can exert a spring effect for biasing the rotary element 5.

The inner surface shape of the opening of the spring bearing portion 7-3 is made divergent from a position near the opening toward the opening so that at the time of mounting the coil spring 8, an end portion of the coil spring is guided by such divergent opening, indicated at 14, without being caught in the opening and is inserted loosely into the spring bearing portion 7-3. The coil spring is then press-fitted and held on the internal bottom of the spring bearing portion 7-3.

The method of anchoring the rear end portion of the coiled spring 8 with respect to the interior of the spring bearing portion 7-3 is not limited to the above method. There may be adopted such a structure as illustrated in FIG. 2 in which internal threads 15 are formed in the inner surface of the internal bottom portion of the spring bearing portion 7-3 and the coiled spring is held herein by threaded engagement.

Figure 2:
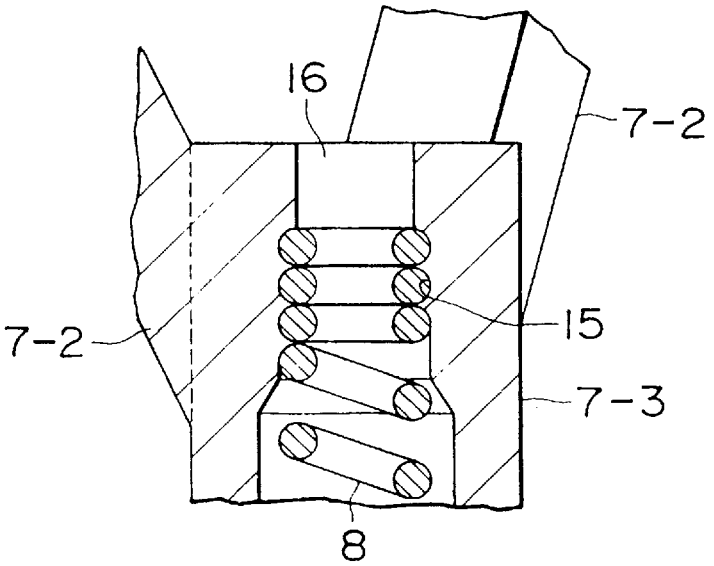
FIG. 2 is an enlarged view similar to FIG. 1C, showing another embodiment.
Figure 3:
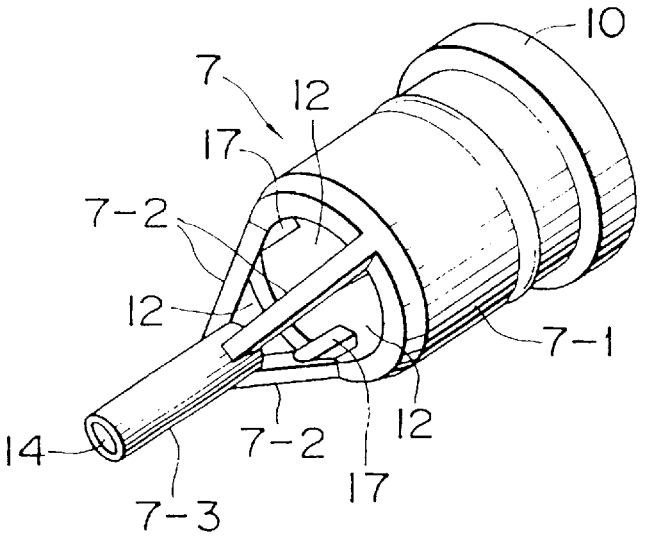
FIG. 3 is a perspective view of a support piece.

As shown in FIG. 2, a flow portion 16 communicating with the interior of the spring bearing portion 7-3, such as a hole or a slit having an appropriate opening, with a diameter smaller than the inside spiral diameter of the coiled spring 8, is formed, for example, in the internal bottom of the spring bearing portion 7-3, so that when the writing tool is left standing with it pen point facing up, the ink 2 which has entered the spring bearing portion 7-3 during use of the writing tool returns to the ink tank 1 without remaining in the interior of the spring bearing portion. Thus, the solid component of the ink 2 which begins to precipitate with the lapse of time returns to the ink tank 1 through the flow portion 16 before agglomeration thereof in the interior of the spring bearing portion.

On the inner surfaces of the connections between the cylindrical portion 7-1 and the support arms 7-2 of the support piece 7 are formed protrusions 17 projecting inward (in the axial direction of the cylindrical portion 7-1) to improve the strength of the connection between the cylindrical portion and the support arms.

Figure 4:
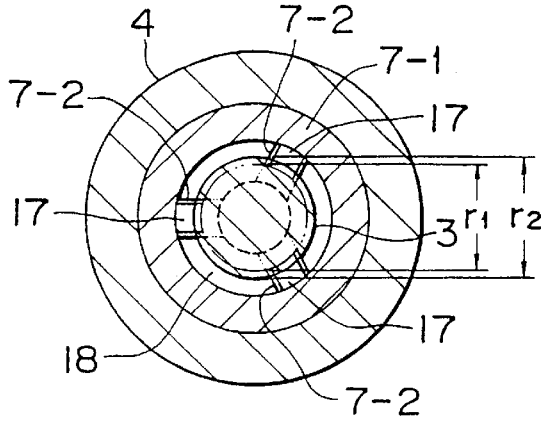
FIG. 4 is an enlarged cross sectional view taken on line IV—IV in FIG. 1A.
Figure 5:
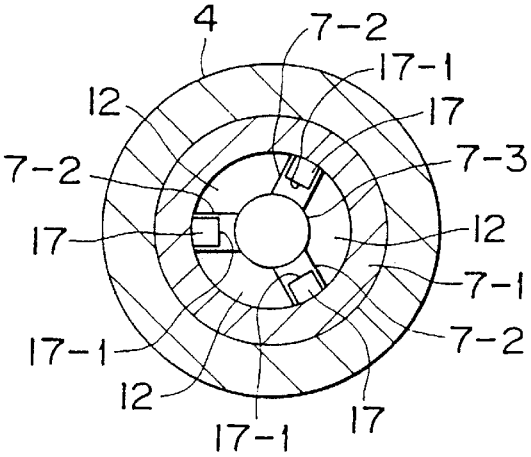
FIG. 5 is an enlarged cross sectional view taken on line V—V in FIG. 1A.

An inside diameter r1 of a circle, formed by connecting projecting inner surfaces 17-1 of the protrusions 17 in the circumferential direction, has a smaller size than an outside diameter r2 (see FIG. 4) of the rod-like agitation member 3 ($r1<r2$), and projecting end faces 17-2 of the protrusions 17 on the rear-end opening side of the cylindrical portion 7-1 project so as to be positioned in the same plane in the circumferential direction. Therefore, when the pen point is faced downward for use (writing) of the writing tool, the agitation member 3 is received by the projecting end faces 17-2 of the protrusions 17 (the state of FIG. 1A).

According to the above construction, an ink flow clearance 18 is ensured between the agitation member 3 and the cylindrical portion 7-1, so that when the writing tool is used, the ink 2 stored in the ink tank 1 flows quickly through the ink flow clearance 18 and ink flow ports 12 into the spring bearing portion 7-3 of the support piece 7 and into the ferrule holder 4 with the coil spring 8 disposed inside concentrically. Thus, while the writing tool is in use, the ink 2 is supplied continuously from the ink tank 1 into the ferrule holder 4 and hence there is no fear of ink shortage.

Therefore, according to the writing tool of the present invention as described above, when the writing tool after use is left standing with it pen point facing upward, the ink 2 present in both tip 6 and ferrule holder 4 returns quickly into the ink tank 1 through the ink flow ports 12, which form large openings, without staying in the interiors of the tip and holder. Thus, it is not likely that the solid component of ink 2 will be precipitated and agglomerated to form a cake within the tip 6 and ferrule holder 4, especially within the holder 4.

Moreover, while the coil spring 8 is held firmly in the spring bearing portion 7-3 of the support piece 7 by press-fitting or by threaded engagement and while the centering of the coil spring 8 with respect to the axis of the tip 6 is effected with certainty by insertion of the cylindrical portion 7-1 into the ferrule holder 4, the coil spring 8 can be inserted from the interior of the ferrule holder 4 into the tip 6. Thus, the coil spring mounting operation can be done in a simple and efficient manner, and consequently it is possible to improve the productivity.

Further, the depth of insertion of the support piece 7 into the ferrule holder 4 is limited by abutment of the retaining flange 10 of the cylindrical portion 7-1 with the restricting stepped portion 9 of the ferrule holder 4. That is, the support piece 7 can always be held in a predetermined fixed position in the ferrule holder 4. Accordingly, the coil spring 8 can be kept in abutment at a constant biasing force with the rotary element 5 disposed in the interior of the tip front end, and hence it is possible to attain the stabilization of quality.

According to the writing tool of the present invention, as set forth above, when the writing tool after use is left standing with its pen point facing up, the ink present in both tip and ferrule holder can return to the ink tank quickly through the ink flow ports of the support piece which has large open ports. Therefore, the problem caused by the precipitation and agglomeration of the solid component of ink which separates into solids and liquid with the lapse of time and consequent formation of cake is solved and the opening/closing function of the valve mechanism constituted by both inward front-end edge of the tip and rotary element can be ensured positively and stably over a long period of time. Thus, the present invention is suitable for a writing tool of a construction wherein a solid-liquid separable ink is stored in an ink tank and is discharged and transferred onto a writing paper by an opening motion of a valve mechanism constituted by both an inward front-end of a tip and a rotary element. For example, the present invention is useful as an applicator for the correction of clerical errors which applicator applies a correcting solution to a clerical error portion.

I claim:

1. In a writing tool wherein a tip is connected through a ferrule holder to an ink tank which contains both a solid-liquid separable ink and an agitation member, and a rotary element is disposed in the interior of the front end of the tip, the rotary element being biased forward into contact with an inward front-end edge by means of a coiled spring, the improvement characterized in that:

in the interior of the ferrule holder is disposed a support piece which holds the coiled spring and which has ink flow ports, the ink flow ports providing communication between the ink tank and the ferrule holder, the support piece being an integrally molded piece comprising a cylindrical portion having front and rear openings and disposed within the ferrule holder in close contact with the inner surface of the holder, a plurality of support arms inclined in a generally conical shape gradually from a front-end opening edge of the cylindrical portion toward the front, and a cylindrical spring bearing portion supported contiguously to the front ends of the support arms and concentrically toward the front, the rear end side of the coiled spring is inserted and held in the spring bearing portion to support the coiled spring concentrically and resiliently toward the rotary element, and the solid-liquid separable ink in the ink tank is supplied into the ferrule holder through ink flow ports, the ink flow ports each having an opening area at least from the rear end of the spring bearing portion to the front-end opening edge of the cylindrical portion in the space between adjacent support arms.

2. A writing tool according to claim 1, wherein inwardly projecting protrusions are formed on the inner surfaces of the connections between the cylindrical portion and the support arms of the support piece, and an inside diameter of a circle obtained by connecting projecting inner faces of the protrusions in the circumferential direction is a size smaller than an outside diameter or a spherical diameter of the agitation member.

3. A writing tool according to claim 1, wherein a retaining flange projecting outward in the shape of a ring is formed at the rear-end opening edge of the cylindrical portion, and the inner surface of a connection port of the ferrule holder for connection with the ink tank is formed with a restricting stepped portion for abutment with the retaining flange at the time of insertion of the support piece into the ferrule holder to restrict the depth of the support piece inserted into the ferrule holder.

4. A writing tool according to claim 1, wherein the rear end side of the coiled spring is inserted into the spring bearing portion of the support piece by press-fitting or by threaded engagement.

* * * * *